US008714161B2

(12) United States Patent
Liu

(10) Patent No.: US 8,714,161 B2
(45) Date of Patent: May 6, 2014

(54) ELECTRONIC CIGARETTE WITH SOLID TOBACCO SUBSTANCE

(76) Inventor: Qiuming Liu, Guangdong (CN)

( * ) Notice: Subject to any disclaimer, the term of this patent is extended or adjusted under 35 U.S.C. 154(b) by 188 days.

(21) Appl. No.: 13/409,133

(22) Filed: Mar. 1, 2012

(65) Prior Publication Data

US 2013/0167853 A1 Jul. 4, 2013

Related U.S. Application Data

(63) Continuation-in-part of application No. PCT/CN2011/084960, filed on Dec. 29, 2011.

(51) Int. Cl.
*A24F 1/22* (2006.01)

(52) U.S. Cl.
USPC ..... 131/273; 131/194; 128/202.21

(58) Field of Classification Search
USPC ..... 131/194, 273, 328–329; 128/202.21
See application file for complete search history.

(56) References Cited

U.S. PATENT DOCUMENTS

2010/0242974 A1* 9/2010 Pan ..... 131/273
2011/0155153 A1* 6/2011 Thorens et al. ..... 131/329
2013/0228191 A1* 9/2013 Newton ..... 131/329

* cited by examiner

*Primary Examiner* — Richard Crispino
*Assistant Examiner* — Eric Yaary

(57) ABSTRACT

The present invention relates to an electronic cigarette with solid tobacco substance, which includes a shell with a mouthpiece at one end; a reservoir in the shell for storing tobacco substance; an atomizing device in the shell having an atomizing cup, an atomizer in the atomizing cup for vaporizing tobacco substance; and an aerosol passage connecting the mouthpiece with the atomizing cup; and a guiding unit for drawing tobacco substance from the reservoir to the atomizing device. The atomizing cup is accommodated in the reservoir, the guiding unit penetrates sidewall of the atomizing cup and extends in the reservoir, and solid tobacco substance encases the atomizing cup and guiding unit therein. The present invention solves the problem of solid tobacco substance melting slowly and uneasy assembly of the cigarette; and obtains to improve the melting efficiency of solid tobacco substance and facilitate the assembly.

11 Claims, 4 Drawing Sheets

ELECTRONIC CIGARETTE WITH SOLID TOBACCO SUBSTANCE

This is a continuation-in-part of PCT international application No. PCT/CN2011/084960, filed Dec. 29, 2011.

BACKGROUND OF THE INVENTION

The present invention relates to a kind of electronic cigarette with solid tobacco substance.

Referring to FIGS. 1-2, a first electronic cigarette with solid tobacco substance comprising: a power source 2', a controlling unit 3', an atomizing device 4', a reservoir 5' for storing solid tobacco substance 6', guiding unit 7' for drawing tobacco substance flowing, and a mounting seat 8', which are set in a shell 1'.

The shell 1' comprises an inhaling shell 11' and a mouthpiece 12' at an end of the inhaling shell 11'. The power source 2' is electrically associated with the controlling unit 3'. The controlling unit 3' is electrically associated with corresponding part of the atomizing device 4'. The atomizing device 4' comprises an electric heat wire 41, an atomizing cup 42', a ceramic seat 43' and a seal gasket 44'. The atomizing cup 42' comprises an aerosol passage 421', an atomizing chamber 422' enclosed by side walls 424' and bottom wall 425', and guiding holes 423' defined in the bottom wall 425'. The aerosol passage 421' of the atomizing cup 42' extends along an axial line of the reservoir 5' and traverses the reservoir 5' to communicate with the mouthpiece 12'. The ceramic seat 43' is set in the atomizing cup 42' for supporting the electric heat wire 41'. The seal gasket 44' is used to seal the atomizing cup 42' so as to prevent tobacco substance leaking from the open end of the atomizing cup 42'. The top of the reservoir 5' is directly communicated with the mouthpiece 12', and the bottom of the reservoir 5' tightly abuts against the bottom end of the atomizing cup 42'. The guiding unit 7' is used to draw the liquefied tobacco substance from the reservoir 5' to the atomizing device 4' for atomization. Both ends of the guiding unit 7' respectively insert through the guiding holes 423' of the atomizing cup 42' to extends into the reservoir 5', and the middle section of the guiding unit 7' is positioned in the atomizing chamber 422' of the atomizing cup 42'. The electric heat wire 41' winds around the middle section of the guiding unit 7'. Tobacco substance is transmitted from two ends of the guiding unit 7' to the middle section, and is vaporized to aerosol by the electric heat wire 41'. The aerosol flows from the aerosol passage 421', through the mouthpiece 12', and then is discharged to outside of the shell 1' or inhaled in a mouth of the human. The mounting seat 8' is used for holding the atomizing device 4', and is positioned at the open end of the atomizing cup 42'. The electric heat wire 41' is electrically connected with the controlling unit 3' by electric wire respectively passing through the mounting seat 8', seal gasket 44', ceramic seat 43', and then connecting the electric heat wire 41' with the controlling unit 3'.

The electronic cigarette has such drawbacks as:

1. since the side wall 424' of the atomizing cup 42' is disposed outside of the reservoir 5', the bottom wall 425' of the atomizing cup 42' abuts against the bottom of the reservoir 5', heat generated from the electric heat wire 41' is concentrated on the side wall 424', the side wall 424' conducts heat to the bottom wall 425', and then conducts heat to solid tobacco substance in the reservoir, it takes a long time to conduct heat to the solid tobacco substance, and the contact area is small, which results that solid tobacco substance melts slowly, the amount of melting tobacco substance is very little, and correspondingly little liquid tobacco substance is drawn in the atomizing chamber 422' for vaporization. Therefore, aerosol generated from vaporization is very little.

2. A diameter of the shell 1' is not big under the limitation of structure, in assembly, both ends of the guiding unit 7' respectively pass from the atomizing chamber 422' and through the guiding holes 423' in the bottom wall 425'; since the material of the guiding unit 7' is relative soft and wound with electric heat wire 41', the guiding unit 7' with electric heat wire 41' needs to be preset on the ceramic seat 43', and positive wire and negative wire shall be respectively inserted through the seal gasket 44' and ceramic seat 43', and connected with the electric heat wire 41' in advance; then, the guiding unit 7', the electric heat wire 41' connected with electric wires, the ceramic seat 43' and the seal gasket 44' are all inserted in the atomizing chamber 422' with both end of the guiding unit 7' passing through guiding holes 423' and extending in the reservoir 5', however, it is a very difficult operation in the shell 1' to align and insert the guiding unit 7' to the guiding holes 423'. The assembly is not easy and is rather time-consuming.

BRIEF SUMMARY OF THE INVENTION

A main object of the present invention is to provide an electronic cigarette with solid tobacco substance, which improves melting efficiency and melting amount of tobacco substance, and facilitates assembling the electronic cigarette with solid tobacco substance.

To obtain the above object, an electronic cigarette with solid tobacco substance comprises: a shell with a mouthpiece at one end thereof; a reservoir in the shell for storing tobacco substance; an atomizing device in the shell comprising an atomizing cup, an atomizer in the atomizing cup for vaporizing tobacco substance into aerosol, and an aerosol passage connecting the mouthpiece with the atomizing cup; and a guiding unit for drawing tobacco substance from the reservoir to the atomizing device. The atomizing cup is accommodated in the reservoir, the guiding unit penetrates sidewall of the atomizing cup and extends in the reservoir, and solid tobacco substance in the reservoir encases the atomizing cup and the guiding unit therein.

Further, the atomizing cup has whole or part of sidewalls and a bottom wall thereof received in the reservoir.

Further, the sidewall of the atomizing cup defines at least one guiding hole for passing the guiding unit, and the guiding unit passes through the guiding hole to extend into the reservoir.

Further, there are two guiding holes which is symmetrically set in the sidewall of the atomizing cup relative to a central line of the atomizing cup; two ends of the guiding unit respectively penetrate two guiding holes and extend into the reservoir, and a middle section of the guiding unit is received in the atomizing cup and inserted into the atomizer.

Further, the electronic cigarette with solid tobacco substance comprises a seal cap set at one end of the reservoir; the seal cap is bored with the aerosol passage therein, and is engaged with outer wall of the aerosol passage by interference fit.

Further, the electronic cigarette with solid tobacco substance further comprises a mounting seat, the reservoir is fixed in the shell via the mounting seat, and an end of the reservoir is tightly engaged with the mounting seat.

Further, the atomizing cup is mounted on the mounting seat, and an open end of the atomizing cup is sealed by the mounting seat.

Further, the atomizing device comprises an atomizer seat for holding the guiding unit; the atomizer seat is received in the atomizing cup, and is engaged in the atomizing cup by interference fit.

Further, the atomizing device comprises a seal washer for sealing the atomizing cup; the seal washer is set at one end of the atomizing cup, and is engaged in the atomizing cup by interference fit.

Further, the atomizer is electric heat wire, and the guiding unit is made from cotton or glass fiber material.

The present invention has such advantages as: since the atomizing cup has whole or part of the sidewall and the bottom wall received in the reservoir, the guiding unit penetrates sidewall of the atomizing cup and extends in the reservoir, and the atomizing cup and the guiding unit are coated with the liquid tobacco substance in the reservoir, heat generated from the atomizer in atomizing cup is rapidly transferred to solid tobacco substance in the reservoir by the sidewall and bottom wall of the atomizing cup, which increases the melting efficiency and melting amount of the solid tobacco substance; at the same time, as the guiding holes being defined in sidewall of the atomizing cup, in assembly, one end of the guiding unit hooked and taken by a leading tool, extends from sidewall of the atomizing cup to the atomizing chamber, traverses through the atomizer fixed in the atomizing chamber by a clamp tool, and penetrate through the other sidewall of the atomizing cup; then, the electric wires of the atomizer respectively penetrate the atomizer seat and seal washer, and reserve terminals for connecting with the controlling unit; after that, the atomizer seat and the seal washer with electric wires therethrough are successively mounted in the atomizing cup, therefore, the atomizer is sealed and held in the atomizing chamber of the atomizing cup. Such structure of the atomizing cup avoids taking time and efforts to insert the guiding unit from the bottom wall to the reservoir, and facilitates mounting the guiding unit.

A further detailed description to the present invention follows with reference to the accompanying drawings.

DETAILED DESCRIPTION OF THE INVENTION

Figure 1:
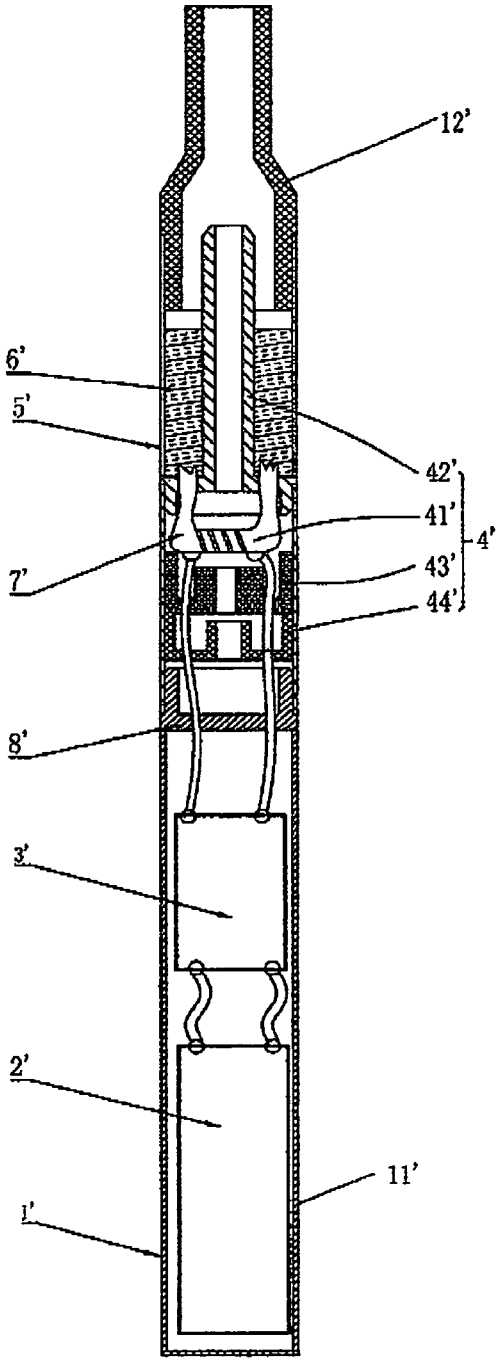
FIG. 1 Prior Art
FIG. 1 is a cross-section view of a first electronic cigarette with solid tobacco substance.
Figure 2:
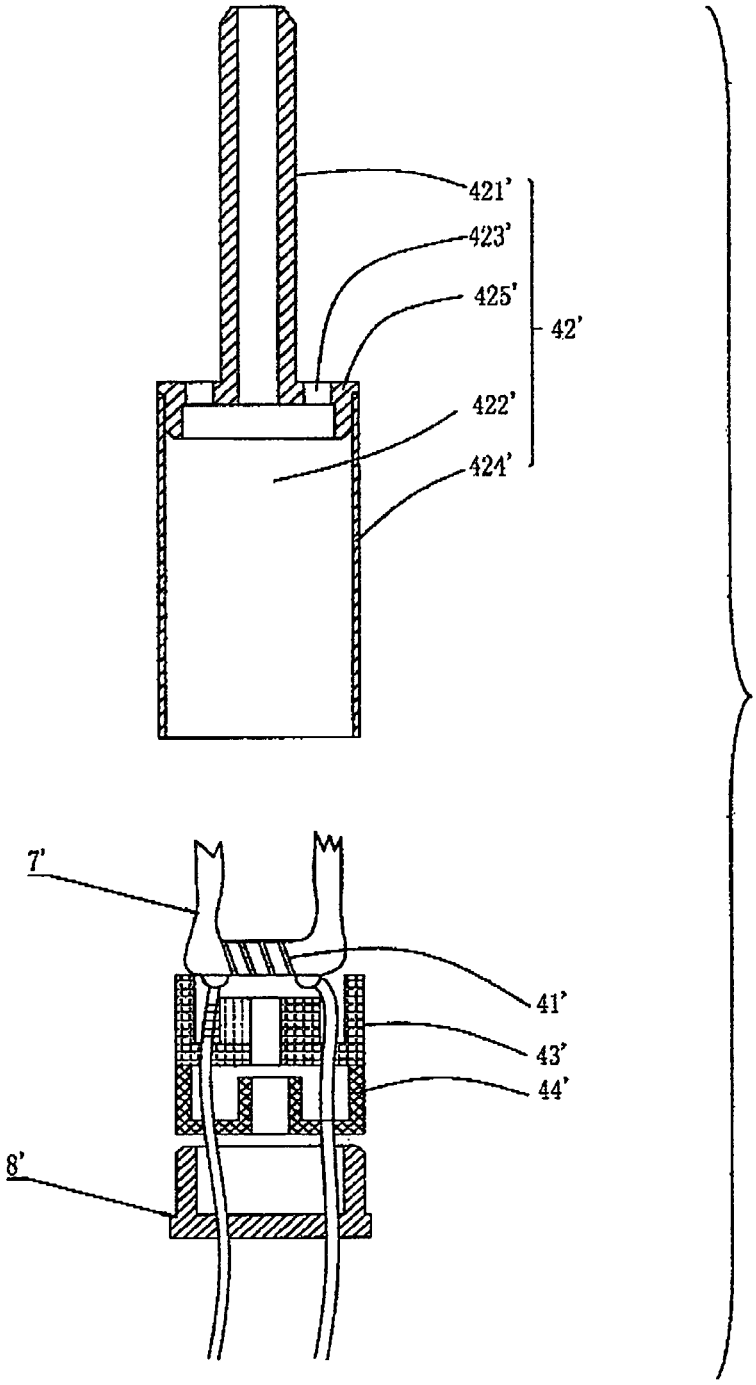
FIG. 2 Prior Art
FIG. 2 is a cross-section view of some parts of the first electronic cigarette.
Figure 3:
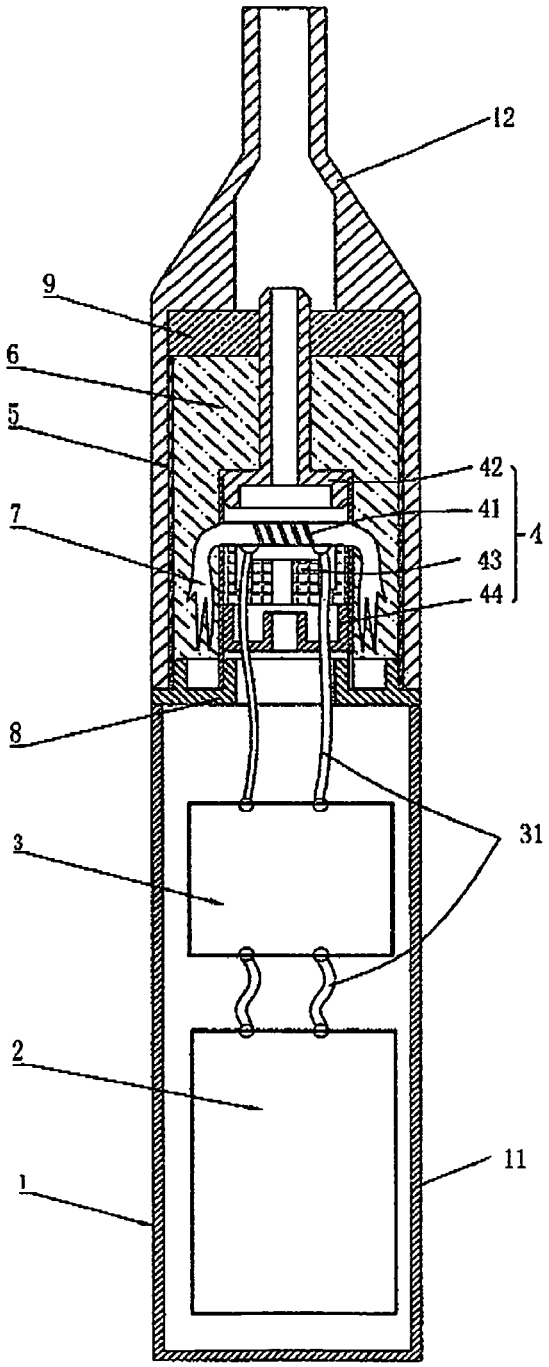
FIG. 3 is a cross-section view of an electronic cigarette with solid tobacco substance of the present invention.
Figure 4:
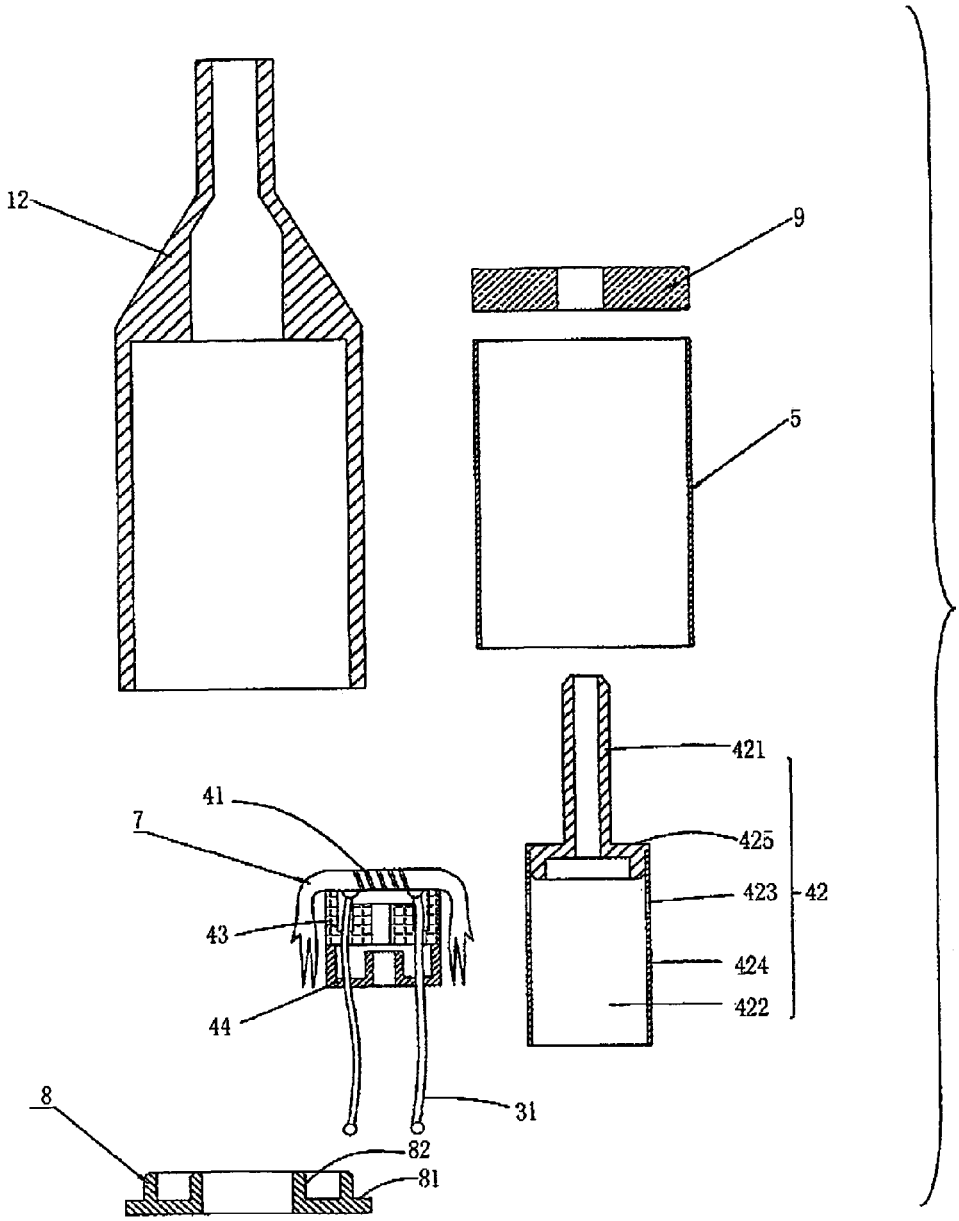
FIG. 4 is a cross-section view of some parts of the electronic cigarette of the present invention.

Referring to FIGS. 3-4, an electronic cigarette with solid tobacco substance of the present invention, comprises a power source 2, a controlling unit 3, an atomizing device 4, a reservoir 5 for storing solid tobacco substance 6, a guiding unit 7 for drawing liquid tobacco substance flowing, a mounting seat 8, and a seal cap 9, which are set in a shell 1.

The shell 1 comprises an inhaling shell 11 and a mouthpiece 12 disposed at one end of the inhaling shell 11. The inhaling shell 11 and mouthpiece 12 both have a hollow-cavity structure.

The power source 2 provides electric power to the atomizing device 4, which is any kind of dry battery or rechargeable storage battery. The controlling unit 3 is electrically connected with the power source 2, and electrically connects corresponding parts of the atomizing device 4 by electric wires 31.

The atomizing device 4 comprises an atomizer 41, an atomizing cup 42, an atomizer seat 43 and a seal washer 44. The atomizer 41 vaporizes tobacco substance to generate aerosol, and in this embodiment, the atomizer 41 is electric heat wire which winds around the guiding unit 7. The atomizer 41 is electrically connected with the controlling unit 3 by electric wires 31. The atomizing cup 42 comprises an aerosol passage 421, an atomizing chamber 422 which is enclosed by side walls 424 and a bottom wall 425, and guiding holes 423 defined in the side walls 424. The aerosol passage 421 is used for aerosol gas being discharged from the atomizing chamber 422 to outside of the atomizing cup 42. In assembly, the aerosol passage 421 traverses the reservoir 5 along a central line of the reservoir 5 and communicates with the mouthpiece 12. The guiding holes 423 are defined in the side walls 424, and preferably positioned near the bottom of the atomizing cup 42. In this embodiment, there are two guiding holes 423, which are symmetrically positioned according to the central line of the atomizing cup 42. The atomizer seat 43 is set in the atomizing cup 42 for supporting the atomizer 41 and guiding unit 7. In this embodiment, the atomizer seat 43 is made from ceramic material. The seal washer 44 seals atomizing cup 42 so as to prevent tobacco substance leaking from open end of the atomizing cup 42. The atomizing cup 42 is wholly made from metal material. The bottom wall 425 and part or whole of the sidewalls 424 of the atomizing cup 42 are received in the reservoir 5. The reservoir 5 has a hollow cylindrical structure, which is used for store solid tobacco substance 6. The reservoir 5 has a top end thereof sealed by the seal cap 9 and the bottom end tightly engaged with the mounting seat 8. The atomizing cup 42 and the guiding unit 7 are clad in solid tobacco substance 6 in the reservoir 5.

The guiding unit 7 is used to draw melted tobacco substance after being heated from the reservoir 5 to atomizing chamber 42 of the atomizing device 4 for vaporization. Both ends of the guiding unit 7 respectively pass through the guiding holes 423 of the atomizing cup 42 and extend into the reservoir 5, and the middle section of the guiding unit 7 is disposed in the atomizing chamber 422 of the atomizing cup 42. The atomizer 41 winds around the middle section of the guiding unit 7. Melted tobacco substance is saturated from both ends of the guiding unit 7, diffused into the middle section and vaporized into aerosol by the atomizer 41. Aerosol passes from the passage 421 through the mouthpiece 12, and emits to outside of the shell 1 or is absorbed in the mouth of human. The guiding unit 7 is engaged in the guiding holes 423 by interference fit. The guiding unit 7 is made from cotton or glass fiber, so that the melted tobacco substance is absorbed from both ends of the guiding unit 7 by immersion wetting, is diffused into the middle section thereof for vaporization, and the aerosol penetrates the material of the guiding unit 7 to entering the passage 421.

The mounting seat 8 holds the atomizing device 4, and is disposed at the open end of the atomizing cup 42. The atomizer 41 is electrically connected with the controlling unit 3 by electric wires 31. The electric wires 31 respectively penetrate the mounting seat 8, seal washer 44, atomizer seat 43, and are electrically connected with the atomizer 41. The configuration and size of the mounting seat 8 is designed adapted to inner wall of the shell 1, is made from silica gel material, and is engaged in the shell 1 by interference fit. The mounting seat 8 defines two annular grooves 81, 82 therein for respectively receiving the bottom end of the reservoir 5 and the open end of the atomizing cup 42 therein.

The seal cap 9 is set at the top of the reservoir 5, is tightly engaged in the reservoir 5, and may be made from silica gel material. Since the reservoir 5 has the top is sealed by the seal cap 9 for the purpose of filtering tobacco substance, it prevents tobacco substance is directly absorbed in the human body when smoking.

In smoking, the power source 2 set in the shell 1 supplies electric power to the atomizer 41, and the controlling unit 3 controls the heat temperature of the atomizer 41. A melting point of solid tobacco substance generally is in an arrange from 42 degrees Celsius to 62 degrees Celsius, therefore, the heat temperature of the atomizer 41 is necessary to set for melting the solid tobacco substance, such as just above 62 degrees Celsius. Since the whole atomizing cup 422 is received in the reservoir 5, and is clad in solid tobacco substance, heat generated from the atomizer 41 can be rapidly transferred to solid tobacco substance by the sidewall of the atomizing cup 42, thus improves melting efficiency and melting amount of tobacco substance. The atomizer 41 is configured as a spring cylinder with a central hole therethrough, is soldered with electric wires 31, and then is fixed in the atomizing chamber 422 by clamping tool. In assembly, one end of the guiding unit 7 hooked and taken by a leading tool, passes through the guiding hole 423 of the atomizing cup 42, enters the atomizing chamber 422, inserts into the central hole of the atomizer 41, and penetrate the guiding hole 423 in the other sidewall of the atomizing cup 42; then, the electric wires 31 of the atomizer 41 respectively penetrate the atomizer seat 43 and seal washer 44, and reserve terminals for connecting with the controlling unit 3; after that, the atomizer seat 43 and the seal washer 44 with electric wires therethrough are successively mounted in the atomizing cup 42, therefore, the atomizer 41 is sealed and held in the atomizing chamber 423 of the atomizing cup 42. Such structure of the atomizing cup 42 facilitates mounting the guiding unit 7 so as to easily and rapidly mount the guiding unit 7.

In the view of disclosure to the embodiments of the present invention, it will be apparent to one skilled in the art that modifications and/or substitutes may be made without departing from the scope and spirit of the invention.

What is claimed is:

1. An electronic cigarette with solid tobacco substance comprising:

a shell with a mouthpiece at one end thereof;

a reservoir in the shell for storing tobacco substance;

an atomizing device in the shell comprising an atomizing cup, an atomizer in the atomizing cup for vaporizing tobacco substance into aerosol, and an aerosol passage connecting the mouthpiece with the atomizing cup;

a guiding unit for drawing tobacco substance from the reservoir to the atomizing device; and a mounting seat;

wherein the atomizing cup is accommodated in the reservoir, the guiding unit penetrates sidewall of the atomizing cup and extends in the reservoir, and solid tobacco substance in the reservoir encases the atomizing cup and the guiding unit therein; the reservoir is fixed in the shell via the mounting seat, and a bottom end of the reservoir is tightly engaged in the mounting seat; the atomizing cup is mounted on the mounting seat, and an open end of the atomizing cup is sealed by the mounting seat; the mounting seat has a configuration and size adapted for inner wall of the shell, is made from silica ad material, and is engaged in the shell by interference fit; and the mounting seat defines two annular grooves therein for respectively receiving the bottom end of the reservoir and the oven end of the atomizing cup therein.

2. The electronic cigarette with solid tobacco substance according to claim 1, wherein the atomizing cup has whole or part of sidewalls and a bottom wall thereof received in the reservoir.

3. The electronic cigarette with solid tobacco substance according to claim 1, wherein sidewall of the atomizing cup defines at least one guiding hole for passing the guiding unit, and the guiding unit passes through the guiding hole to extend into the reservoir.

4. The electronic cigarette with solid tobacco substance according to claim 3, wherein there are two guiding holes which is symmetrically set in the sidewall of the atomizing cup relative to a central line of the atomizing cup; two ends of the guiding unit respectively penetrate the guiding holes and extend into the reservoir, and a middle section of the guiding unit is received in the atomizing cup and inserted into the atomizer.

5. The electronic cigarette with solid tobacco substance according to claim 1, further comprising a seal cap set at a top end of the reservoir; the seal cap is bored with the aerosol passage therein, and is engaged with outer wall of the aerosol passage by interference fit.

6. The electronic cigarette with solid tobacco substance according to claim 1, wherein the atomizing device further comprises a atomizer seat for holding the guiding unit; the atomizer seat is received in the atomizing cup, and is engaged in the atomizing cup by interference fit.

7. The electronic cigarette with solid tobacco substance according to claim 1, wherein the atomizing device further comprises a seal washer for sealing the atomizing cup; the seal washer is set at one end of the atomizing cup, and is engaged in the atomizing cap by interference fit.

8. The electronic cigarette with solid tobacco substance according to claim 1, wherein the atomizer is electric heat wire, and the guiding unit is made from cotton or glass fiber material.

9. The electronic cigarette with solid tobacco substance according to claim 1, wherein the atomizing cup is wholly made from metal material.

10. An electronic cigarette comprising:

a shell with a mouthpiece at one end thereof;

a reservoir in the shell for storing tobacco substance;

an atomizing device in the shell comprising an atomizing cup, an atomizer in the atomizing cup for vaporizing tobacco substance into aerosol, and an aerosol passage connecting the mouthpiece with the atomizing cup;

a guiding unit for drawing tobacco substance from the reservoir to the atomizing device; and a mounting seat;

wherein the atomizing cup is accommodated in the reservoir, the guiding unit penetrates sidewall of the atomizing cup and extends in the reservoir; a bottom end of the reservoir is tightly engaged in the mounting seat, and an open end of the atomizing cup is sealed by the mounting seat; the mounting seat has a configuration and size adapted for inner wall of the shell, and is made from silica gel material.

11. An electronic cigarette comprising:

a shell with a mouthpiece at one end thereof;

a reservoir in the shell for storing tobacco substance;

an atomizing device in the shell comprising an atomizing cup, an atomizer in the atomizing cup for vaporizing tobacco substance into aerosol, and an aerosol passage connecting the mouthpiece with the atomizing cup;

a guiding unit for drawing tobacco substance from the reservoir to the atomizing device; and a mounting seat;

wherein the atomizing cup is accommodated in the reservoir, the guiding unit penetrates sidewall of the atomizing cup and extends in the reservoir; a bottom end of the reservoir is tightly engaged in the mounting seat, an open end of the atomizing cup is sealed by the mounting seat; the mounting seat has a configuration and size adapted for inner wall of the shell, and defines two annular grooves therein for respectively receiving the bottom end of the reservoir and the open end of the atomizing cup therein.

* * * * *